United States Patent [19]

Schmiedeler

[11] 4,271,766

[45] Jun. 9, 1981

[54] COLLAPSIBLE DISPLAY SHELF

[75] Inventor: Edward A. Schmiedeler, Prairie Village, Kans.

[73] Assignee: Sandy, Inc., Kansas City, Mo.

[21] Appl. No.: 61,284

[22] Filed: Jul. 27, 1979

[51] Int. Cl.[3] ..... A47B 43/02

[52] U.S. Cl. ..... 108/111; 108/115; 248/174

[58] Field of Search ..... 108/111, 115; 248/174

[56] References Cited

U.S. PATENT DOCUMENTS

| | | | |
|---|---|---|---|
| 2,123,290 | 7/1938 | Powers | 248/174 |
| 2,940,710 | 6/1960 | Adams | 248/174 |
| 3,124,085 | 3/1964 | Sanchez | 108/115 |
| 3,687,091 | 8/1972 | Boylan | 108/111 |
| 3,863,575 | 2/1975 | Kuns et al. | 108/111 |
| 3,987,737 | 10/1976 | Smith | 248/174 |

*Primary Examiner*—Francis K. Zugel

*Attorney, Agent, or Firm*—Schmidt, Johnson, Hovey & Williams

[57] ABSTRACT

A collapsible display fixture, in the nature of a shelf for displaying merchandise, the display shelf being fabricated from corrugated cardboard sheet and presenting a back wall and a pair of opposed sidewalls extending outwardly from the back wall in perpendicular relationship thereto when the display shelf is in a use condition. The sidewalls are divided into front and rear sections by a fold line whereby the sidewalls may be collapsed into overlying relationship to the back wall when the display shelf is in a storage condition. One or more shelves form a part of the display fixture, the shelves being supported between the sidewalls, in a horizontal plane, when the display fixture is in use. Each of the shelves has a forward marginal edge and a rear marginal edge and there is a wire extending between the sidewalls and through the forward marginal edge of each shelf to swingably support the same whereby each shelf may be swung from its horizontal condition of use to a vertical condition of storage. The wires for swingably mounting each of the shelves are provided with means for coupling the same with the front section of each corresponding sidewall, in the nature of a portion of the wire which is receivable within a recess in the front section, there being a stretch at each end of each wire extending downwardly from the portion and received within a channel formed in the central ply of the front section of each sidewall, with an inturned end on each stretch of the wire, all to the end that the entire display shelf may be quickly and readily moved from a condition of storage to a condition of use or, when emptied of merchandise, from a condition of use to a condition of storage and easy transportation in a flattened condition.

5 Claims, 11 Drawing Figures

COLLAPSIBLE DISPLAY SHELF

BACKGROUND ART

It is desirable, in display fixtures in the nature of shelves which are used in retail establishments for the display of merchandise, to provide a display shelf which is readily fabricated from economical materials and which may be readily stored during transportation but also which may be quickly and easily moved from a storage condition to a display condition of use by the route man or salesman who desires to place merchandise on the display shelf. In a modern retail establishment, it is of course known to have display shelves which are of a fixed nature and also display fixtures and shelves which are of a freestanding type.

The present display shelf is intended to be of the freestanding type and is particularly designed to be carried, for instance, by a bakery route driver, in a flattened condition, during storage and transportation but which shelf may be readily set up to quickly provide a display fixture for merchandise, such as for instance bakery products, within the retail establishment.

To this end, the present display shelf is fabricated from corrugated cardboard material in its entirety, with the exception of a wire which is provided for each shelf and which spans the distance between the sidewalls of the display shelf whereby to permit swinging of the shelves which carry the merchandise from a horizontal condition of use to a vertical condition of storage, it being particularly important that the entire display shelf be collapsible into a very narrow overall dimension whereby the same may be readily handled and stored.

Yet another object is to provide a display shelf which has sufficient unbroken surfaces thereon that advertising material may be readily displayed or printed thereupon to guide the shopper to the contents of the display shelf.

DETAILED DESCRIPTION

Figure 1:
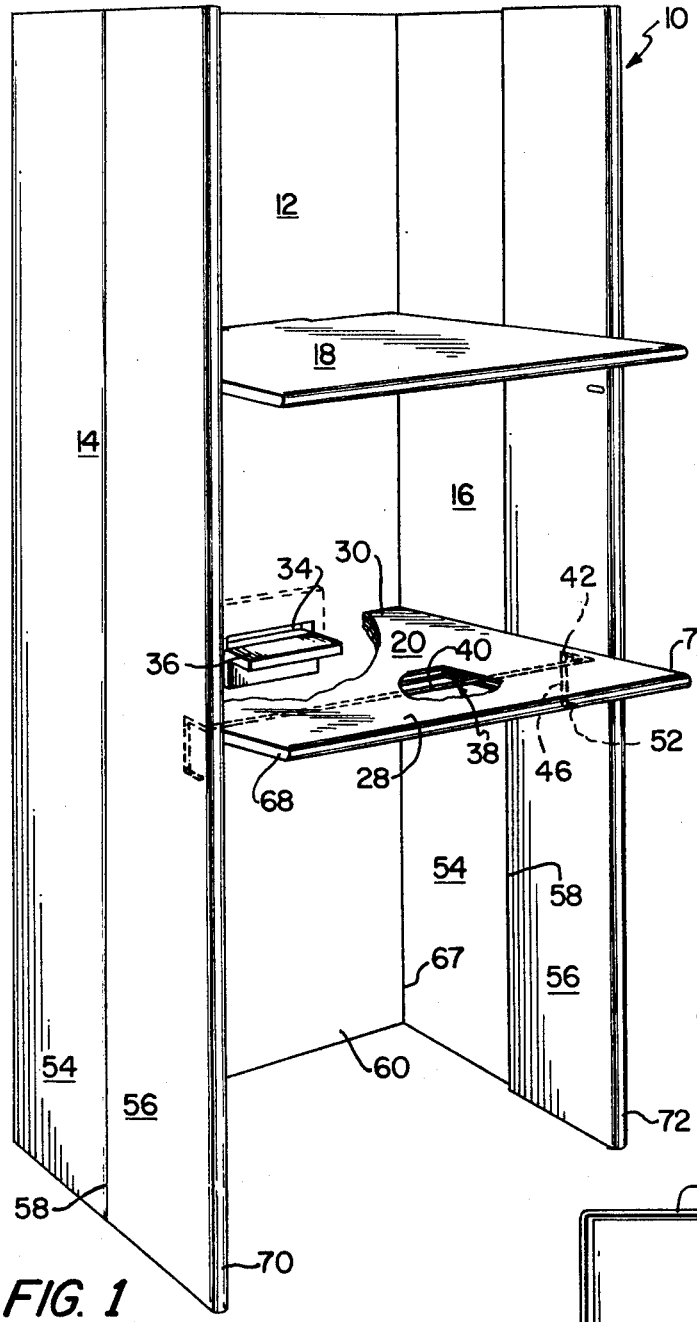
FIG. 1 is a perspective view showing an embodiment of the collapsible display shelf in a condition of use.

The collapsible display shelf is broadly designated by the numeral 10 and, in the embodiment chosen for illustration includes a back wall 12 and a pair of opposed sidewalls 14 and 16 which extend outwardly from the back wall 12 and in perpendicular relationship to the back wall 12 when the display shelf is in a condition of use as illustrated for instance in FIG. 1 of the drawing, the sidewalls 14 and 16 being swingably connected to back wall 12.

While it will be appreciated that the display shelf 10, as hereinafter described, may be of any height or width and contain any number of shelves, as desired, the embodiment selected for illustration includes two shelves 18 and 20, which shelves are disposed in a horizontal plane between the sidewalls 14 and 16 when the display shelf 10 is in a condition of use. The shelves 18 and 20 are each of identical construction and each are mounted between the sidewalls 14 and 16 in the same manner, which will be hereinafter described in detail. Likewise, each of the shelves 18 and 20 carries means for engaging the back wall 12 whereby to stabilize the respective shelves 18 and 20 in their horizontal plane when the display shelf 10 is in a condition of use.

Figure 4:
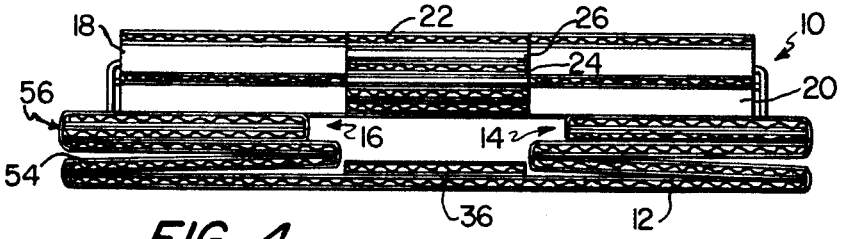
FIG. 4 is a top plan view of the display shelf in a completely collapsed condition of storage.
Figure 6:
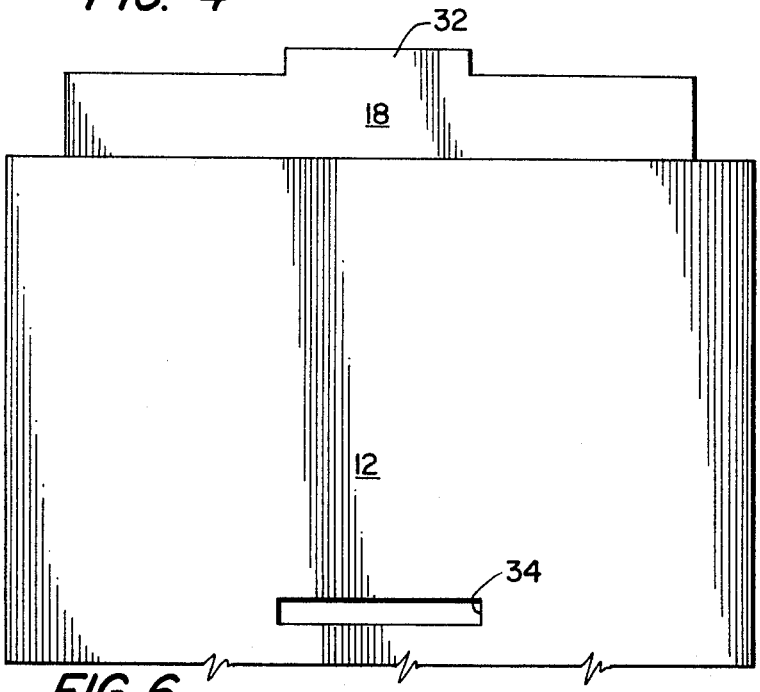
FIG. 6 is a fragmentary rear elevational view showing a portion of the display shelf in its storage condition.
Figure 7:
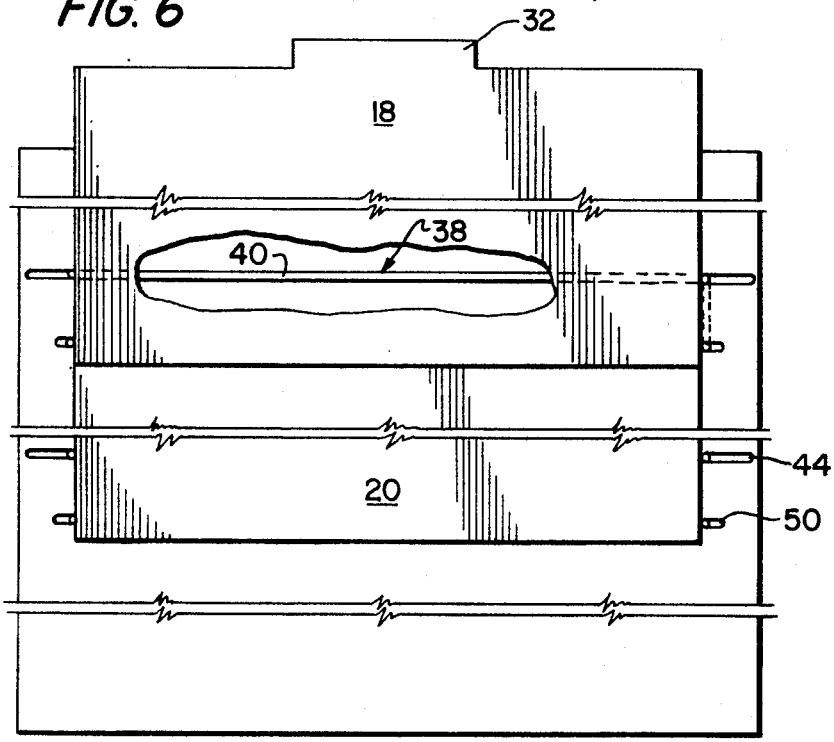
FIG. 7 is a fragmentary front elevational view showing the display shelf in its storage condition.

Specifically, each of the shelves 18 and 20 is fabricated from corrugated cardboard sheet material, there preferably being three plys of such material forming each of the shelves 18 and 20 whereby to provide a relatively rigid, planar shelf which is capable of supporting a supply of merchandise thereon. Thus, as illustrated in FIG. 4 for instance, each shelf is fabricated from a single sheet of corrugated cardboard material which is refolded upon itself to provide a pair of outer plys 22 and 24 and a center ply 26.

Each shelf 18 and 20 presents a forward marginal edge portion 28 and a rear marginal edge portion 30. Each rear marginal edge portion 30 is provided with an outwardly extending tab 32, which is formed of the outer plys 22 and 24 of the cardboard of the corresponding shelf.

The back wall 12 of the display shelf 10 is provided with a centrally disposed notch 34 which notches each receive the corresponding tab 32 on a shelf such as 18 or 20 when the shelves are disposed in their horizontal condition of use. Further support and stabilization for each of the shelves is provided by an inwardly extending flap 36, suitable secured to the back wall 12 directly beneath notch 34. Thus the engagement of tab 32 in notch 34 and the support of the underside of rear marginal edge 30 of the shelf serves to stabilize the rear portion of each of the shelves of the display fixture 10 and to insure that the same will not swing downwardly when loaded with merchandise.

The forward marginal edge 28 of each shelf 18 and 20 for instance is swingably supported by a wire 38, which spans the distance between sidewalls 14 and 16 and extends through the forward marginal edge 28 of each shelf, whereby to span the distance between the sidewalls 14 and 16. In this regard, wire 38 would extend through the center ply 26 of a shelf such as 18 or 20, there being a suitable opening through said center ply whereby to receive the wire 38 readily and permit swinging movement of the shelf 20, for instance, about said wire 38.

The configuration of wire 38 takes the form of a central length 40, which is received within the forward marginal edge 28 of each of the shelves, the wire 38 having comparable configurations at each end thereof for mounting said respective ends in the sidewalls 14 and 16.

Figure 8:
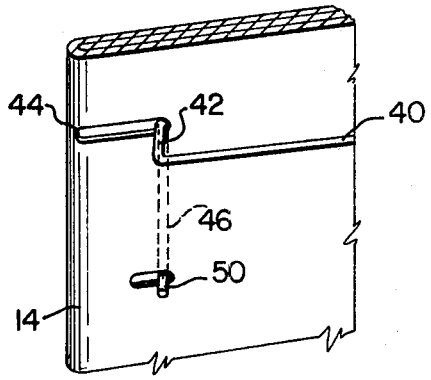
FIG. 8 is an enlarged fragmentary perspective view of the left-hand, inner sidewall of the display shelf, viewing FIG. 1, and showing the means by which the shelf supporting wire is connected to the sidewall of the display shelf, in a storage condition.
Figure 9:
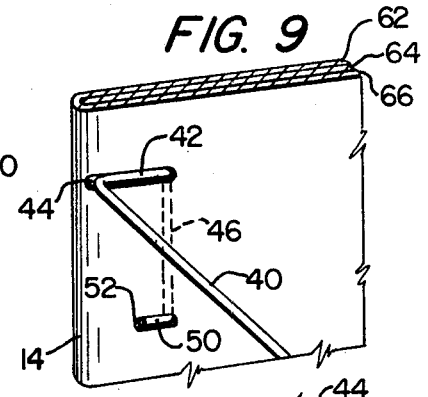
FIG. 9 is a perspective view comparable to that of FIG. 8 and showing the state of the shelf supporting wire when the display shelf is in a condition of use.
Figure 10:
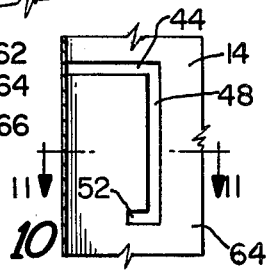
FIG. 10 is a fragmentary view of the central ply of corrugated cardboard of the front section of the sidewall and showing the recess and channel which receive the end of the wire.
Figure 3:
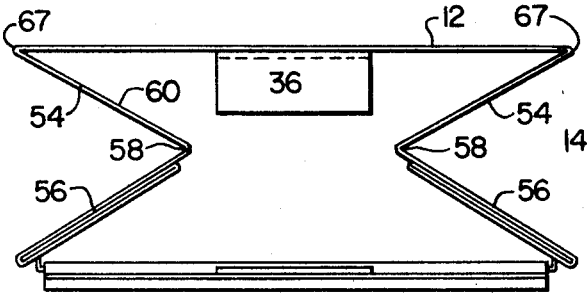
FIG. 3 is a top plan view showing the display shelf in a partially collapsed condition, intermediate its condition of use and its condition of storage.
Figure 2:
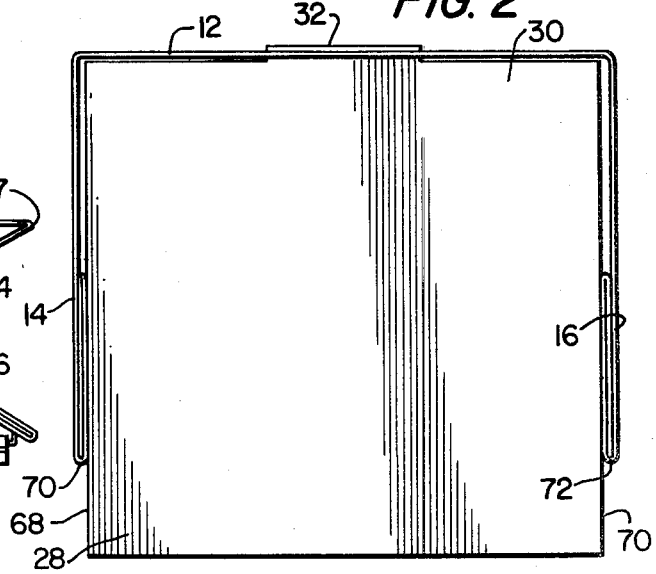
FIG. 2 is a top plan view of the display shelf in its condition of use.

Specifically, and as illustrated in FIGS. 8, 9 and 10 for instance, the length of wire 40, at each of its ends, has a portion 42 which extends perpendicularly to said length and which portion 42 enters a recess 44, provided in the corresponding sidewall such as 14. The wire then has a stretch 46 which extends downwardly from portion 42, and which stretch 46 is received within a channel 48 formed in the center ply of the corrugated cardboard which makes up sidewall 14 for instance.

At its ultimate end, the wire 38 is provided with an in-turned end 50 which is selectively received within a hole 52, which is likewise provided in the corresponding sidewall. The end 50 and the portion 42 lie in spaced-apart parallel horizontal planes and length 40 lies in the same horizontal plane as does the portion 42.

To accommodate the respective ends of the wire 38, the sidewalls 14 and 16 are each comprised of a rear section 54 and a front section 56, the sections 54 and 56 being interconnected, throughout their length, by a fold line 58.

It is desirable that the back wall 12 and the rear section 54 of each of the sidewalls 14 and 16 be fabricated from a single ply of corrugated cardboard material. However, it is also desirable that the front section 56 of each of the sidewalls 14 and 16 be fabricated from three plys of corrugated cardboard material, which may be readily accomplished by refolding the plies upon themselves as illustrated for instance in FIG. 4 of the drawings.

Figure 11:
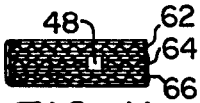
FIG. 11 is a sectional view taken on line 11—11 of FIG. 10.

Thus, viewing FIGS. 8–11 of the drawings for instance it will be seen that the single ply of cardboard material 60, which makes up back wall 12 and rear sections 54 of each of the sidewalls 14 and 16, is refolded upon itself to constitute front sections 56 of each of the sidewalls 14 and 16, each of the front sections being made up of three layers or plys of corrugated cardboard material, these being designated as 62, 64 and 66, the inner ply being 66, the central ply being 64 and the outer ply being designated as 62. As illustrated in FIGS. 10 and 11, the central ply 64 has formed therein the channel 48 as well as the inner portion of recess 44 and hole 52. Said recess 44 and hole 52 extend through the inner ply 66, as illustrated in FIG. 8 whereby to permit movement of the ends of wire 38 which are carried by front sections 56.

FIG. 8 of the drawings illustrates the position and condition of wire 38, its central length 40, portion 42, stretch 46 and in-turned end 50 when the display shelf 12 is folded flat to a storage condition. It is particularly notable that, when the display shelf 10 is in said condition, the portions 42 extend a sufficient distance from their corresponding front sections 56 to permit accommodation of the width of a shelf such as 18 and 20 between the length 40 of the wire and the inner ply 66 of the respective front sections 56 of the sidewalls 14 and 16, all as clearly illustrated in FIG. 5 of the drawings.

When the display shelf 10 is moved from its condition of storage to a condition of use, the wire 38 assumes the position shown in FIG. 9 and wherein portion 42 is seated within recess 44 and the in-turned end 50 is received within the hole 52, the shelf being supported, in its horizontal position, as illustrated in FIG. 1 of the drawings for instance.

In utilization of the display shelf 10, which, as noted above, may be of any width or height and may have the desired number of shelves such as 18 and 20, the same is initially carried in a collapsed, flat condition as shown for instance in FIG. 4 of the drawings. It will be appreciated that, in said condition, the overall width of the display shelf 10 is minimal inasmuch as it folds to a compact, collapsed condition, all to the end that it may be readily stored.

When it is desired to place the display shelf 10 in a condition of use, as illustrated in FIG. 1, the sidewalls 14 and 16 are moved outwardly by swinging the same along lines of bend 67, by which the sections 54 are connected to back wall 12 and through utilization of fold lines 58 whereby to place sections 54 and 56 of each sidewall 14 and 16 in the same plane. When this is done, the shelves, which would then be in a condition extending upwardly from their respective supporting wires 38, are swung downwardly, about said wires 38 whereby to move the tabs 32 of the shelves against the inner face of back wall 12 and ultimately into and through their corresponding notches 34 and with the lower face of each of the shelves in engagement with the upper face of the flap 36. The display shelf is then in full condition for use and merchandise may be placed upon the shelves 18 and 20. The shelves 18 and 20 are fully stabilized not only by the provision of the wire 38 which extends through the forward marginal edge thereof but also by virtue of the fact that the side edges 68 and 70 are in snug engagement with the inner faces of respective sidewalls 14 and 16 and tab 32 is received within notch 34, the rear marginal edge of each shelf also being supported by virtue of the presence of flap 36.

Figure 5:
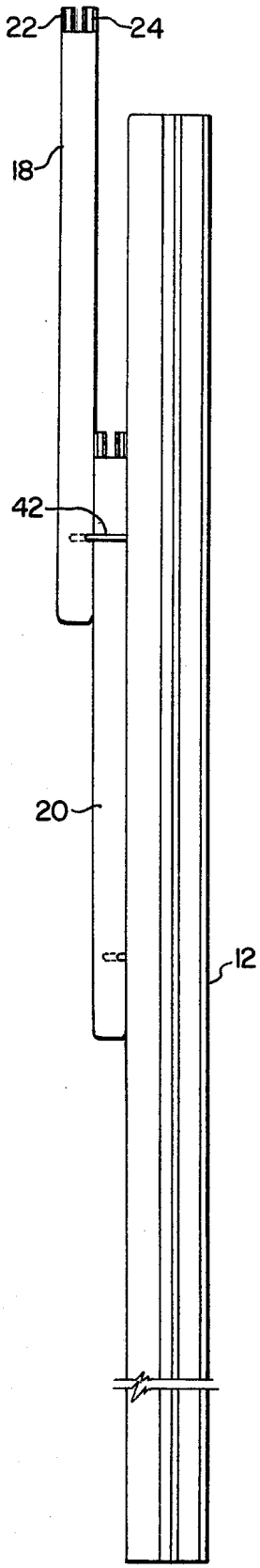
FIG. 5 is a side elevational view of the display shelf in its storage condition.

When it is then desired to again place the display shelf 10 in a collapsed condition of storage, one may push outwardly on the back wall 12 whereby to free tab 32 from its engagement within notch 34, then swinging each of the shelves upwardly to a generally vertical position, in substantial alignment with the normally forward edges 70 and 72 of the sidewalls 14 and 16. Once this has been accomplished the user may push inwardly on each of the sidewalls, at fold line 58 thereby causing the sidewalls to swing inwardly along lines of bend 67 and to move into flat, overlying relationship with the back wall 12, the shelves in turn, being in flat, overlying relationship with the folded sidewalls 14 and 16 and particularly front sections 56 thereof, when the display shelf is in its folded condition. Perfectly flat folding is insured by virtue of the fact that the flap 36 is of such a dimension as to lie between the folded or collapsed sidewalls 14 and 16, as illustrated in FIG. 4. Further, the width of the lower shelf such as 30 is accommodated by portion 42 of wire 38, as illustrated in FIG. 5 whereby to permit complete flat collapsing of the display shelf 10 into a condition of storage.

Having thus described the invention, what is claimed as new and desired to be secured by Letters Patent is:

1. A collapsible display shelf comprising:

a back wall;

a pair of opposed sidewalls extending outwardly from said back wall in perpendicular relationship to the back wall when the display shelf is in a use condition, said sidewalls each having a front section and a rear section, there being a fold line between said sections to permit collapsing of said sidewalls into overlying relationship to the back wall when the display shelf is in a storage condition;

at least one shelf disposed in a horizontal plane between said sidewalls when the display shelf is in said use condition, said shelf having a forward marginal edge and a rear marginal edge;

a wire carried by said sidewalls and spanning the distance therebetween for swingably mounting said shelf whereby it may be swung from its horizontal condition of use to a vertical storage condition overlying said collapsed sidewalls and said back wall, said wire having a central length extending through the forward marginal edge of the shelf and a portion at each end extending perpendicularly to said central length, said portions each being receivable within a recess formed in corresponding front sections of the sidewalls when the display shelf is in a condition of use; and means on the rear marginal edge of the shelf for engaging the back wall, whereby to stabilize the shelf in said horizontal plane when the display shelf is in said condition of use.

2. A collapsible display shelf as set forth in claim 1, said portions of the wire each having a corresponding stretch extending downwardly therefrom and received within a channel formed in the front sections of the sidewalls.

3. A collapsible display shelf as set forth in claim 2, there being an in-turned end on each stretch and movable from within the channel when the display shelf is in a condition of use through a hole in the front sections of corresponding sidewalls when the display shelf is placed into a condition of storage.

4. A collapsible display shelf as set forth in claim 3, said end and said portion lying in spaced apart, parallel, horizontal planes.

5. A collapsible display shelf as set forth in claim 4, said portions of each end of the length extending a sufficient distance from their corresponding front sections when the display shelf is in a storage condition to accommodate the width of the shelf between said length of the wire and the respective front sections of the sidewalls whereby to permit flat collapsing of the display shelf.

* * * * *